US005488847A

United States Patent [19]

Lai et al.

[11] Patent Number: 5,488,847

[45] Date of Patent: Feb. 6, 1996

[54] PICK PROOF LOCK

[76] Inventors: Ming Lai, 27550 Hillcrest, Apt. 2F, Mission Viejo, Calif. 92692; Shui T. Lai, 1223 Orchard Glen Cir., Encinitas, Calif. 92024

[21] Appl. No.: 157,447

[22] Filed: Nov. 26, 1993

[51] Int. Cl.[6] ..... E05B 15/00

[52] U.S. Cl. ..... 70/419; 70/372; 70/375; 70/492; 70/DIG. 9

[58] Field of Search ..... 70/419, DIG. 9, 70/492, 372, 375, 434, 436, 391, 431, 421, 495, 496, DIG. 33

[56] References Cited

U.S. PATENT DOCUMENTS

| | | | |
|---|---|---|---|
| 551,154 | 12/1895 | Beasley | 70/419 |
| 1,406,574 | 2/1922 | Mantanfel | 70/419 |
| 1,565,558 | 12/1925 | Fremon | 70/375 |
| 1,657,039 | 1/1928 | Schafer | 70/492 |
| 2,283,489 | 5/1942 | Crousore | 70/493 X |
| 2,298,698 | 10/1942 | Hofmann | 70/358 |
| 2,890,582 | 6/1959 | Navarro | 70/492 X |
| 3,172,968 | 3/1965 | Arendt | 70/492 X |
| 3,462,983 | 8/1969 | Evanish | 70/337 |
| 3,462,983 | 8/1969 | Evanish | 70/337 |
| 3,709,006 | 1/1973 | Seidewand | 70/419 X |
| 3,738,135 | 6/1973 | Seidewand | 70/372 X |

FOREIGN PATENT DOCUMENTS

| | | | |
|---|---|---|---|
| 1508681 | 11/1967 | France | 70/372 |
| 414779 | 6/1925 | Germany | 70/337 |

*Primary Examiner*—Lloyd A. Gall
*Attorney, Agent, or Firm*—Gilliam, Duncan, Harms

[57] ABSTRACT

A directional control and time delay interlock for making a key operable rotatable tumbler lock substantially pick-proof. When the proper key is inserted the core of the lock is rotatable in a first direction for elevating a biased pawl from locking engagement with a cam surface carried by the rotatable portion of the lock. The distal end of a pawl engaging an indentation in the rotatable portion of the lock prevents initial rotation of the rotatable portion of the lock in a second direction opposite to the first direction of rotation. After rotation in the first direction of rotation, the distal end of the pawl is elevated away from the rotational portion of the lock freeing its engagement with the rotatable portion of the lock. With the pawl elevated, the rotational portion of the lock can be quickly rotated in the second direction past the pawl before the distal end of the pawl returns under a slight bias to the surface of the rotatable portion of the lock. The quick rotation of the rotatable portion of the lock rotates the indentation away from the distal end of the pawl preventing engagement therewith allowing the lock core to rotate to the lock open position. Anyone attempting to pick the lock in a conventional manner will be prevented from rotating the core of the lock past the key insertion position due to the tumblers and the pawl engagement interrupting the rotation.

13 Claims, 3 Drawing Sheets

PICK PROOF LOCK

BACKGROUND OF THE INVENTION

Conventional pin- or disk-tumbler locks can be picked by a well-known method with pick tools and tension wrenches. In this lock picking procedure, a tension wrench is used to apply a tension force on the rotational plug of the lock to be picked. The tension force provides the plug (rotational portion or core of the lock) a tendency to rotate toward a lock open direction of rotation. Simultaneously, a pick tool is used to move the tumblers one at a time to the shear line of the lock. When all tumblers are aligned at the shear line, the tension force applied by the wrench causes the plug to rotate toward the lock open position so as to unlock the lock.

As the conventional pin- or disk-tumbler locks have been in use over the past hundred years, their structures and picking methods are well known. Varieties of pick tools and pick guns are commercially available. Continuing use of these locks is at great risk to non-authority picking.

Many so-called high security locks have been invented to guard against lock picking. The drawbacks of these locks are having very complicated structures and requiring very sophisticate precision machining. Consequently, high security locks are expensive and therefore have very limited circulation.

SUMMARY OF THE INVENTION

A locksmith can pick a conventional lock in seconds with simple pick tools and tension wrenches. So can an experienced thief. The instant invention hereinafter described is directed to a key operated rotate-to-open lock which by adding a directional-control and time-delay interlock and by using modified tumblers makes a conventional tumbler lock pick-proof. An interlock prevents the lock rotatable core from rotating toward an open direction once the core is stopped at the orientation of key insertion. To rotate past the interlock so as to unlock the lock, the core has to be rotated first in a direction opposite to the direction of rotation to open the lock and then rotated in a direction to open the lock, passing the key inserting orientation within a predetermined time interval. If the forward rotation of the core is interrupted at the key inserting orientation, which is unavoidable for the commonly used lock-picking method, the interlock will be engaged and the core prevented from any rotation in the direction for opening the lock. The use of the modified tumblers adds extra difficulty for one to align the tumblers to the shear line when using with a pick tool. The application of the interlock alone will make the lock-picking virtually impossible. Combining this interlock with the modified tumblers will make the locks pick-proof.

The pick-proof lock of the instant invention exploits a directional-control and time-delay interlock mounted inside a conventional pin- or disk-tumbler lock. The interlock comprises a rotatable pawl and an indentation in a cam surface on the rotatable core of the lock which when engaged sets a special rotational locking engagement between the core and the shell (the lock's stationary housing). The core is prevented from rotating in a second unlock direction but is free to rotate in a first direction opposite to the second direction when the proper key is first inserted. The interlock can be deactivated to uncouple the core from the shell by rotating the core in the first direction or when the core is rotated toward the key-inserting orientation in the second direction. Within a preset period of time after the interlock is deactivated, i.e. when the distal end of the pawl disengages the indentation, the core and the shell remain uncoupled. If the core rotates in the second direction past the key-inserting orientation within this preset time interval, the core is free to rotate further to unlock the lock. However, if an improper key or no key is used as in the case of lock picking, the core rotation in the second direction will be interrupted by the lock's spring-loaded tumblers at the key-inserting position and the core will not be able to pass this position within the preset time interval. The interlock then again engages the shell and rotation of the core in the second direction is prevented until the core is again rotated in the first direction. Therefore, the lock-picking motion will never be able to pass the key-inserting orientation, and therefore, the conventional lock-picking method will not be able to rotate the core to an unlocked position.

The pick-proof lock of the instant invention further improves security by using modified pin- or disk-tumblers. The modified tumblers have notches on the pin or disk tumblers, which makes much more difficult for one attempting to pick a lock to align all the tumblers to the shear line with a pick tool. As a result, it is virtually impossible for one picking the lock to get the core past the key-inserting orientation within the preset time interval of the interlock, unless the correct key is used. The pick-proof lock of the instant invention can be simple in structure, reliable in operation, convenient to use, and inexpensive to produce.

An object of this invention is to provide a pick proof conventional pin- or disk-tumbler lock.

Another object of this invention is to provide an interlock mechanism for addition to a conventional tumbler lock to prevent picking.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

Figure 6A:
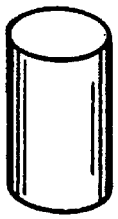
PRIOR ART FIGURE 6a
Figure 6B:
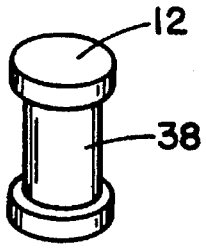
Figure 7:
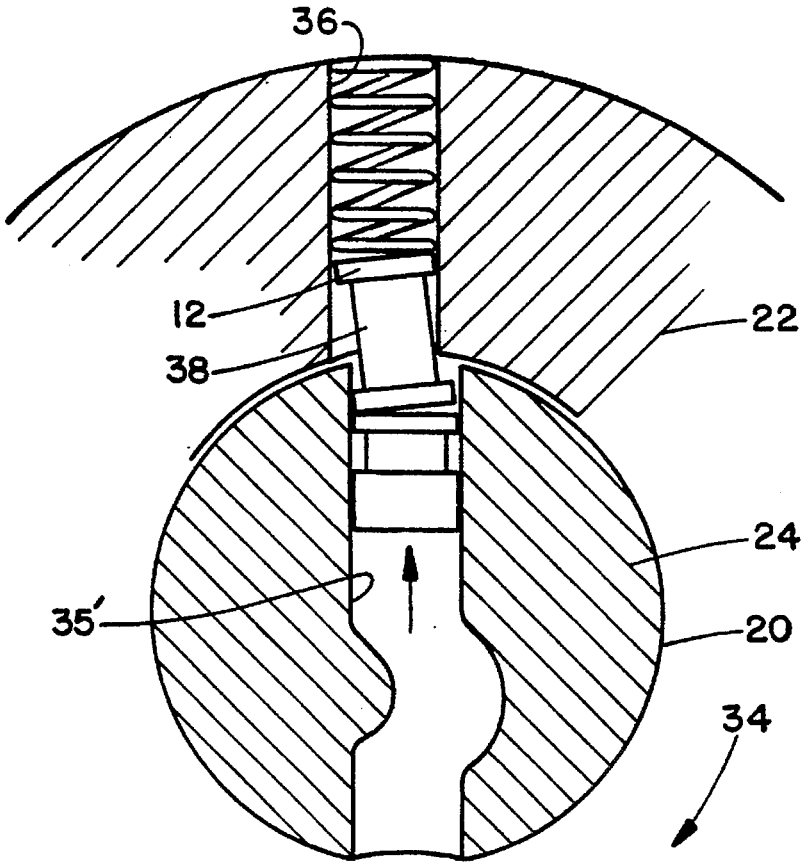
Figure 8A:
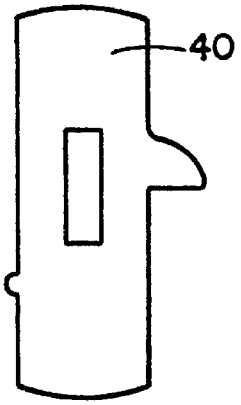
PRIOR ART FIGURE 8a
Figure 8B:
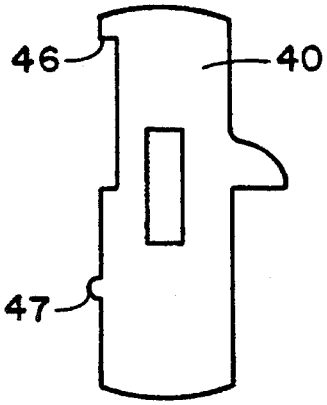
Figure 9:
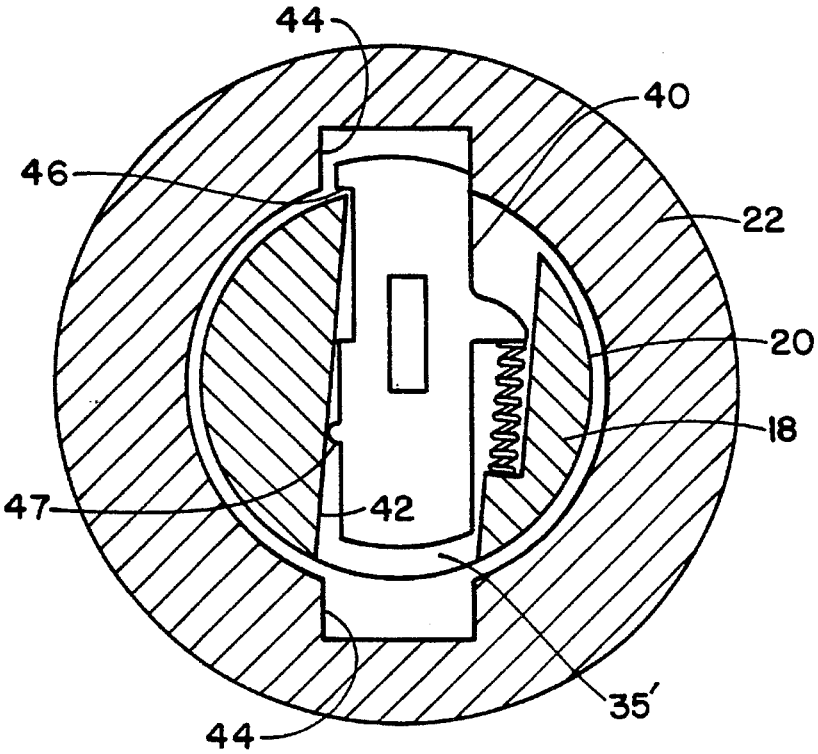

FIG. 6*a* depicts a first embodiment of a prior art conventional key lock tumbler;

FIG. 6*b* depicts a modified key lock tumbler of the instant invention;

FIG. 7 depicts the key lock tumbler of the instant invention pushed to the shear line of the lock;

FIG. 8*a* depicts a conventional state of the art disk tumbler;

FIG. 8*b* depicts a modified disk tumbler of the instant invention;

FIG. 9 depicts a schematic showing of the disk tumbler of FIG. 8*b* positioned in a stuck or jammed position which cannot be pulled down to the shear line of the lock.

DETAIL DESCRIPTION OF THE DRAWING FIGURES

Figure 1:
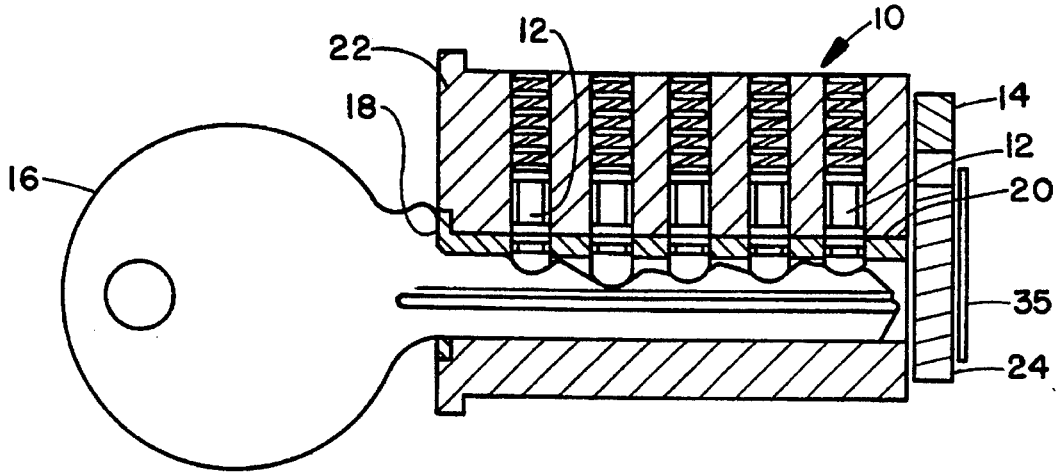
FIG. 1 is a cutaway showing of a cylinder lock with notched pin tumblers and an attachment of a directional-control and time-delay interlock.

FIG. 1 shows a cross-sectional schematic diagram of a conventional cylinder lock 10 with specially configured pin tumblers 12 of the invention and an attachment of a directional-control and time-delay interlock 14. The pin tumblers 12 can be more clearly seen in drawing FIG. 6*b* and are cylindrical with a larger circumference at each end thereof relative to the middle portion therebetween. The lock cylinder is a common one of prior art. When the proper (correct) key 16 is inserted into the core or plug portion 18 as shown, all of the pin tumblers 12 are aligned with the shear line 20 of the lock shell 22 and the core 18 would be rotational in a conventional clockwise manner to an unlock position if the interlock 14 was not present.

Figure 2:
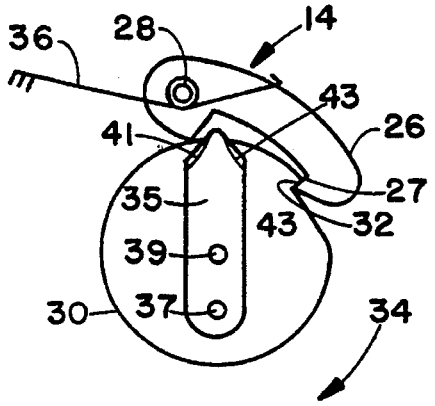
FIG. 2 depicts a showing of a mechanical directional-control and time-delay interlock positioned at an initial setting.

FIG. 2 is a detailed schematic diagram of the interlock 14 which includes a mechanical directional-control and time-delay mechanism. The interlock 14 consists of a disk 24, which can be made a part of or mounted on the core 18 of the lock 10, and a hook pawl 26 with a distal end hook 27. The pawl 26 freely rotates around a pivot pin 28 attached to the lock body, e.g. the cylinder or the shell 22 of the lock. On the rim surface 30 of disk 24 there is a cut or indentation 32 to which hook 27 engages to prevent rotation of the core in the direction of arrow 34 but allows rotation in the opposite direction against arrow 34. A spring 36 is used to bias the hook 27 to rest on the rim 30 of the disk 24.

When disk 24 is at rest at an orientation as shown in FIG. 2, hook 27 engages indentation or cut out 32 of the disk 24 preventing the disk from rotating in the direction of arrow 34 (clockwise). A flat flexible strip 35 is mounted on one side of the disk 24 by pin 37 and pivot pin 39. Pivot 39 is the connection from the core for rotating the disk 24. The spring strip 35 is bent upwardly from the plane of the paper in the showings of FIGS. 2–5 in such a way that its edge 41 is tapered away from the surface of disk 24 and edge 43 is tapered toward disk 24. When the disk 24 is rotated in the direction against arrow 34, the edge 43 passes along side of the pawl 26 and acts as a cam springing the strip 35 toward the viewer of the FIGS. 2–5 preventing the strip 35 from engaging the pawl 26 when the core is rotated from the FIG. 2 to the FIG. 3 positions. When the core is rotated from the FIG. 3 to the FIG. 5 position past the FIG. 4 position, the edge 43 engages the pawl 26 causing the pawl to rotate upward as the disk 24 rotates. By the increased elevation of the pawl the core can be further rotated to a position which the indentation is positioned as shown in FIG. 5 thereby allowing the lock to be rotated to a lock open position.

Figure 3:
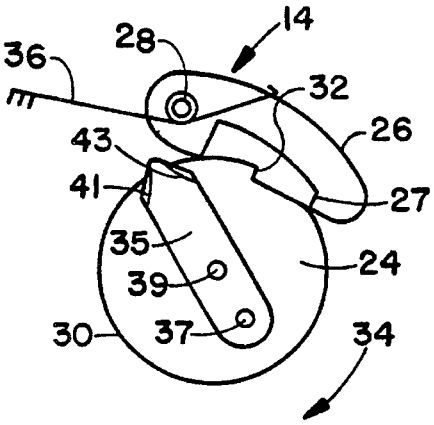
FIG. 3 depicts the interlock of FIG. 2 with the core of the lock rotated counterclockwise.
Figure 4:
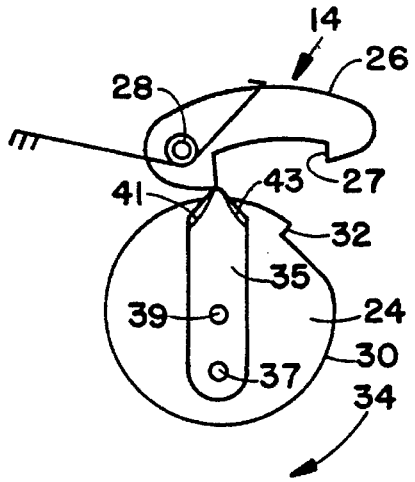
FIG. 4 depicts the interlock of FIG. 2 with the core rotated slightly in a clockwise rotation from the FIG. 3 position.

Further stated, FIG. 3 illustrates the position of the disk 24 after a slight counterclockwise rotation. A further clockwise rotation of the core, as shown in FIG. 4, causes strip 35 to rotate hook upwards. If the disk is then rotated clockwise continuously, the indentation 32 will pass the orientation of FIG. 2, as herein before discussed, before the hook 27 can come down and engage the indentation 32 to stop the rotation, see FIG. 5. At this position the disk is free to further rotate clockwise. If the disk stops at the orientation of FIG. 2, however, the hook comes down into indentation 32 preventing any further clockwise rotation of disk 24. If the hook engages the indentation 32, the device is back to its original setting shown in FIG. 2.

In the application of pick-proof locks, FIG. 2 represents the key=inserting orientation of disk 24 and thus the lock position of core 18. To unlock the lock, i.e. rotate core 18 relative to shell 22, the core needs to rotate to its orientation in FIG. 5.

Figure 5:
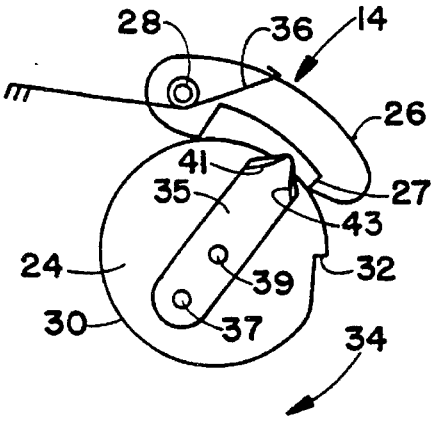
FIG. 5 depicts the interlock of FIG. 2 rotated to a lock open position in a clockwise direction.

When the proper key 16 is inserted and core 18 is rotated first counterclockwise and then quickly clockwise, the core (with disk 24) can pass smoothly from the orientation of FIG. 2 to the orientation of FIG. 5 and unlock the lock as it does in a conventional lock.

When a lock picking is attempted at the core orientation of FIG. 2, clockwise! rotation of the core is prohibited. If a rotation is made counterclockwise after all of the tumblers are picked to the shear line 20, the core will be stopped at the orientation of FIG. 2 by the spring loaded tumblers 12 when the core 18 is rotated clockwise. As a result, the lock core is back to the original setting of FIG. 2 and no progress in the lock picking is accomplished.

To make lock picking even more difficult in elevating the tumblers to the shear line of a lock, the pick-proof lock of this invention takes advantage of modified pin or disk tumblers as shown in FIGS. 1, 6*b*, 7, 8*b* and 9. FIG. 1 depicts a lock cylinder with notched pin tumblers as shown in detail in FIG. 6*b*. FIG. 7 depicts a notched pin tumbler 12. When the apertures 35' in the core 18 are not well aligned with the apertures 36 in the shell or fixed portion of the lock 10, the notch 38 may stop the pin from being pushed to the shear line 20, as illustrated in FIG. 7.

With the proper key 16, a lock 10 with notched pin tumblers can be unlocked in the same way as a conventional lock. However, when picking is attempted and a tension wrench is used to twist the plug, the unaligned apertures in the core and in the cylinder make it very time consuming for one to manipulate the notched pins to the shear line 20.

A conventional disk tumbler 40 of FIG. 8*a* can also be modified as shown in FIG. 8*b* in a similar fashion by including a notch 46 cooperating with protuberance 47. When the notches 46 in the core are not lined up with the slots 44 in the shell of the lock as seen in FIG. 9, as in the circumstance of lock picking, the notches 46 prevent the disk tumblers from being pushed to the shear line 20 of the lock.

FIG. 9 depicts a notched disk tumbler stuck between a slightly rotated core and shell. The core 18 catches the inner surface of the notch 46 preventing the core from rotating clockwise toward the lock open position.

The above illustrations are simply examples of a directional-control and time-delay interlock and a modified pin and disk tumbler. There are many mechanisms and structures that can be used to construct the interlock. There are also many ways to modify the pin or disk tumblers.

While the present invention has been described with reference to a particular embodiment thereof, it will be understood that numerous modifications can be made by those skilled in the art without actually departing from the scope of the invention. Accordingly, all modifications and equivalents may be resorted to which fall within the scope of the invention as claimed.

What is claimed is:

1. An improved substantially pick proof key operated tumbler lock assembly comprising:

a lock body;

a core within said lock body and rotatable by a key relative to said lock body in a first direction to a lock open position and in a second, opposite, direction;

a plurality of tumblers extending between said core and said lock body;

a disk having an edge indentation, said disk secured to said core and rotatable therewith;

a pawl pivotally mounted on said body adjacent to said disk, said pawl having a first, hook end for engagement with said edge indentation to prevent rotation of said disk in said first direction;

strip means secured to said disk having an actuation means adjacent to a second end of said pawl, said actuation means configured to bypass said pawl second end when said core and disk are rotated in said second direction and to engage said pawl second end to move the, hook end away from said indention as said core and disk are rotated in the first direction to a lock open position past where the hook end would normally engage said indentation.

2. The tumbler lock assembly according to claim 1 wherein said strip means includes a tip located to encounter said pawl second end as said disk is rotated in either direction, said tip being bent to ride over said pawl second end when said disk is rotated in said second direction and said tip being bent to cause said tip to engage said pawl second end and pivot said pawl hook end away from said indentation when said disk is rotated in said first direction.

3. The tumbler lock assembly according to claim 1 further includes spring means for biasing said pawl hook end toward said disk indentation.

4. The tumbler lock assembly according to claim 1 wherein said tumbler lock assembly is a pin tumbler lock.

5. The tumbler lock assembly according to claim 4 wherein said tumbler lock further includes a plurality of pins slidable in channels extending through said body and core, at least some of said pins having end diameters slidably fitting in said channels and having reduced diameter central regions.

6. The tumbler lock assembly according to claim 1 wherein said tumbler lock assembly is a disk tumbler lock.

7. The tumbler lock assembly according to claim 6 wherein said tumbler lock further includes a plurality of slidable disks for sliding in slots extending through the core and into the lock body, at least some of said disks having an elongated recess and a protuberance.

8. An improved substantially pick proof key operated tumbler lock assembly comprising:

a lock body;

a core within said lock body and rotatable by a key relative to said lock body in a first direction to a lock open position and in a second, opposite, direction;

a plurality of tumblers extending between said core and said lock body;

a disk having an edge indentation, said disk secured to said core and rotatable therewith;

a pawl rotatably mounted on said body adjacent to said disk, said pawl having a first, hook end for engagement with said edge indentation to prevent rotation of said disk in said first direction;

biasing means for biasing said first, hook end towards said edge indentation;

strip means secured to said disk having a tip extending adjacent to a second end of said pawl, said tip being bent to ride over said pawl second end when said disk is rotated in said second direction and said tip being bent to engage said pawl second pawl end to pivot said pawl and move the hook end away from said indention as said core and disk are rotated in the first direction to a lock open position past where the hook end would normally engage said indentation.

9. The tumbler lock assembly according to claim 8 further includes spring means for biasing said pawl hook end toward said disk indentation.

10. The tumbler lock assembly according to claim 8 wherein said tumbler lock assembly is a pin tumbler lock.

11. The tumbler lock assembly according to claim 10 wherein said tumbler lock further includes a plurality of pins slidable in channels extending through said body and core, at least some of said pins having end diameters slidably fitting in said channels and having reduced diameter central regions.

12. The tumbler lock assembly according to claim 8 wherein said tumbler lock assembly is a disk tumbler lock.

13. The tumbler lock assembly according to claim 12 wherein said tumbler lock further includes a plurality of slidably disks for sliding in slots extending through the core and into the lock body, at least some of said disks having an elongated recess and a protuberance.

* * * * *